US007032555B2

(12) United States Patent
Francis

(10) Patent No.: US 7,032,555 B2
(45) Date of Patent: Apr. 25, 2006

(54) MOTORCYCLE ENGINE CAM COVER

(75) Inventor: Kenneth A. Francis, St. Louis, MO (US)

(73) Assignee: Midwest Motorcycle Supply Distributors, Arnold, MO (US)

( * ) Notice: Subject to any disclaimer, the term of this patent is extended or adjusted under 35 U.S.C. 154(b) by 0 days.

(21) Appl. No.: 10/837,992

(22) Filed: May 3, 2004

(65) Prior Publication Data

US 2005/0241606 A1 Nov. 3, 2005

(51) Int. Cl.
*F01L 1/04* (2006.01)

(52) U.S. Cl. ..... 123/90.6; 123/90.38; 123/195 C

(58) Field of Classification Search ..... 123/195 C, 123/90.38, 196 R, 90.6
See application file for complete search history.

(56) References Cited

U.S. PATENT DOCUMENTS

| | | | | |
|---|---|---|---|---|
| D155,741 | S | 10/1949 | Sherman | |
| D339,142 | S | 9/1993 | Middlebrook | |
| D342,956 | S | 1/1994 | Karlsson et al. | |
| D408,829 | S | 4/1999 | Jones | |
| 6,047,667 | A * | 4/2000 | Leppanen et al. | 123/196 R |
| 6,457,449 | B1 | 10/2002 | Troxler et al. | |

* cited by examiner

*Primary Examiner*—Thomas Denion
*Assistant Examiner*—Zelalem Eshete
(74) *Attorney, Agent, or Firm*—Thompson Coburn LLP

(57) ABSTRACT

A cam cover for a motorcycle engine comprises a fluid passageway for crankcase ventilation, a camshaft support, and a crankshaft support. The fluid passageway is routed such that the camshaft support and the crankshaft support are positioned to one side of the fluid passageway. Additionally, the cam cover comprises a piece of sheet material that partially bounds the fluid passageway and creates a settling chamber for separating oil out of mixture with gaseous fluids being vented.

15 Claims, 2 Drawing Sheets

MOTORCYCLE ENGINE CAM COVER

BACKGROUND OF THE INVENTION (1) Field of the Invention

This invention pertains to the field of motorcycle engines. More particularly, this invention pertains to the configuration of crankcase ventilation passageways within motorcycle engine cam covers.

(2) Background

Motorcycle engines often comprise a cam cover that, in addition to supporting the crankshaft and camshaft, create a fluid passageway for venting crankcase gases. In general, each particular model of motorcycle engine is often provided with a particular cam cover by the original equipment manufacturer of the motorcycle.

This invention pertains to a specific type of cam cover of the type that includes a camshaft support, a crankshaft support, and a fluid passageway for venting the crankcase. More specifically, this invention pertains to such a cam cover comprising a fluid inlet opening and a fluid outlet opening that are connected by the fluid passageway and that are positioned on opposite sides of a plane that includes the camshaft axis and the crankshaft axis. In such a cam cover, it is common for the fluid passageway to comprise a tube that extends from the fluid outlet opening toward the fluid inlet opening and that passes between the camshaft support and the crankshaft support. Due to the relatively close spacing of the camshaft support and the crankshaft support, the tube is typically relatively small in cross-sectional area.

The purpose of the fluid passageway is to allow venting of the crankcase so as to prevent pressure buildup resulting from gaseous fluids escaping past the piston rings. Within the crankcase, such gases are turbulent and oil becomes mixed with and suspended by these gases. Thus, it's desirable to provided some means for separating suspended oil from the gas being vented in an effort to reduce pollution and reduce oil buildup on external surfaces of motorcycles. To this end, most cam covers having such fluid passageways comprise some form of settling chamber or region that is adapted and configured to slow the fluid flow prior to being discharged out of the fluid outlet port. Such settling chambers allow oil suspended in the gaseous fluid to fall out of suspension and drain back into the crankcase.

Cam covers of the particular type described above generally have a small settling chamber near their fluid inlet opening. However, the fluid flow rate through the majority of the fluid passageway, which includes the tube and the fluid outlet opening, is relatively high due to the small cross-sectional areas of the tube and the fluid outlet opening. Thus, only a small portion of the entire fluid passageway facilitates the removal of oil from the fluid being discharged. As a result, at least some oil is invariably discharged from the fluid outlet opening of the cam cover.

SUMMARY OF THE INVENTION

The cam cover of the present invention has an improved fluid passageway that allows for a larger size settling chamber or region. This decreases the amount of oil in the mixture of fluid expelled from the venting system of the cam cover.

In one aspect of the invention, a cam cover of a motorcycle engine comprises a main body, a fluid inlet opening, a fluid outlet opening, and a fluid passageway. The main body comprises an internal cavity, a camshaft support, and a crankshaft support. The camshaft support defines a camshaft axis and the crankshaft support defines a crankshaft axis.

The camshaft axis and the crankshaft axis are coplanar such that the camshaft axis and the crankshaft axis define a plane that includes both of said axes. The fluid inlet opening is adapted and configured to allow fluid communication between the internal cavity of the main body and a first region of a fluid environment external to the cam cover. The fluid outlet opening is adapted and configured to allow fluid communication between the internal cavity of the main body and a second region of the fluid environment external to the cam cover and is positioned in a manner such that the plane is between the fluid inlet opening and the fluid outlet opening. The fluid passageway is configured and adapted to channel fluid from the fluid inlet opening to the fluid outlet opening within the internal cavity of the main body. One of either the camshaft axis or the crankshaft axis is positioned between the other of such axes and the fluid passageway.

In another aspect of the invention, a cam cover of a motorcycle engine comprises a main body, a fluid inlet opening, a fluid outlet opening, a piece of sheet material, and a fluid passageway. The main body is a single monolithic part comprising an internal cavity, a camshaft support, and a crankshaft support. The camshaft support defines a camshaft axis and the crankshaft support defines a crankshaft axis. The camshaft axis and the crankshaft axis are coplanar such that the camshaft axis and the crankshaft axis define a plane that includes said axes. The fluid inlet opening is adapted and configured to allow fluid communication between the internal cavity of the main body and a first region of a fluid environment external to the cam cover. The fluid outlet opening is adapted and configured to allow fluid communication between the internal cavity of the main body and a second region of the fluid environment external to the cam cover, and is positioned in manner such that the plane is between the fluid inlet opening and the fluid outlet opening. The piece of sheet material is positioned within the internal cavity defined by the main body and is engaged therewith. The fluid passageway is configured and adapted to channel fluid from the fluid inlet opening to the fluid outlet opening within the internal cavity of the main body, and is defined partially by a portion of the main body and partially by the piece of sheet material.

In yet another aspect of the invention, a method includes a step of providing a motorcycle. The motorcycle comprises a cam cover that has a camshaft support, a crankshaft support, a fluid inlet opening, and a fluid outlet opening. The camshaft support defines a camshaft axis and the crankshaft support defines a crankshaft axis. The camshaft axis and the crankshaft axis are coplanar such that the camshaft axis and the crankshaft axis define a plane that includes both of said axes. The fluid outlet opening is positioned in a manner such that the plane is between the fluid inlet opening and the fluid outlet opening. This method further includes a step of operating the motorcycle in a manner such that a mixture of fluid passes from the fluid inlet opening to the fluid outlet opening within the cam cover. The mixture passes from the fluid inlet opening to the fluid outlet opening in a manner such that one of either the camshaft axis or the crankshaft axis is located between the other of said axes and a region where at least a majority of the mixture traverses the plane.

While the principal advantages and features of the invention have been described above, a more complete and thorough understanding of the invention may be obtained by referring to the drawings and the detailed description of the preferred embodiment, which follow.

Figure 1:
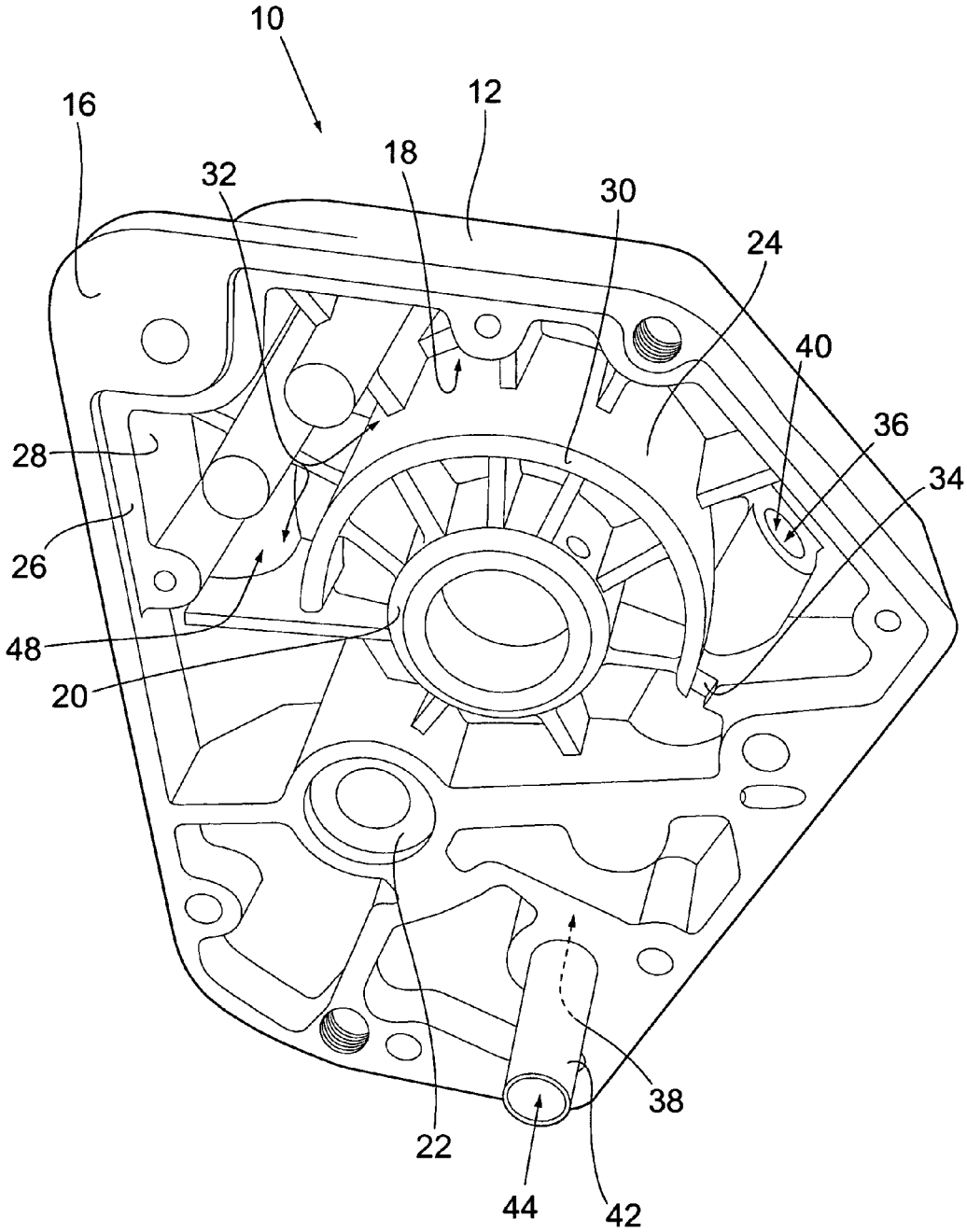
FIG. 1 is a perspective view of a preferred embodiment of a cam cover, shown with a piece of sheet material removed therefrom.

Reference characters in the written specification indicate corresponding items shown throughout the drawing figures.

DETAILED DESCRIPTION OF THE PREFERRED EMBODIMENT

Figure 2:
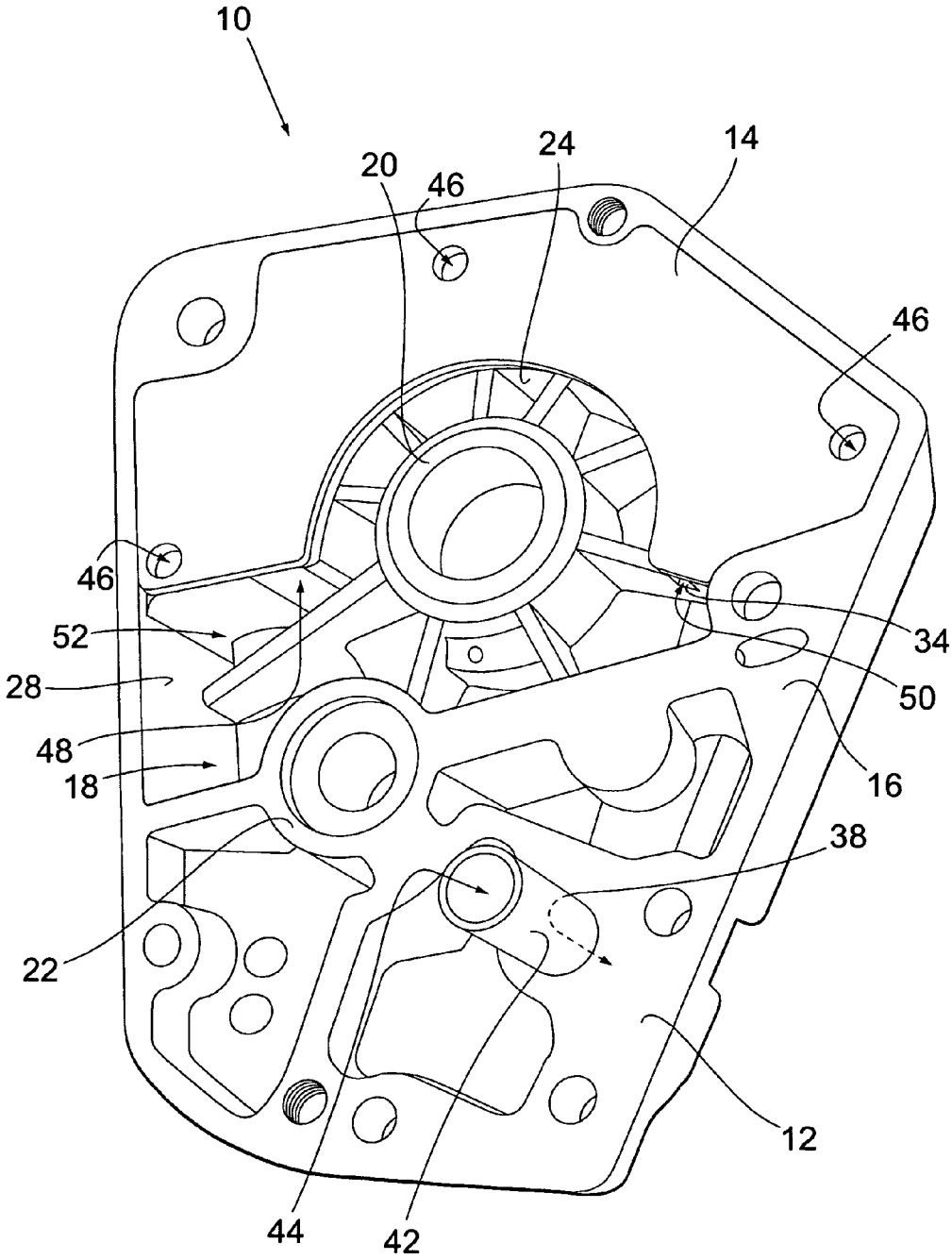
FIG. 2 is a perspective view of the cam cover of FIG. 1, shown with the piece of sheet material in place.

A preferred embodiment of a cam cover in accordance with the invention is shown in FIGS. 1 and 2. In general, the cam cover 10 comprises a main body 12 and a piece of sheet material 14.

The main body 12 of the cam cover 14 is preferably formed as a single monolithic or unitary piece of material. More particularly, the main body 12 is preferably molded out of aluminum, steel, or other suitable materials. The main body 12 has a generally flat surface 16 that is configured and adapted to be mounted against the crankcase of a motorcycle engine. A recess formed into the main body 12 from the flat surface 16 creates an internal cavity 18. The main body 12 is also formed in a manner such that it comprises a camshaft support 20 and a crankshaft support 22. The camshaft support 20 is adapted and configured to support an end of a camshaft (not shown) of the motorcycle engine when the cam cover 10 is secured to the motorcycle's crankcase. Thus, the camshaft support 20 defines a camshaft axis about which the camshaft rotates when the engine is in operation. Likewise, the crankshaft support 22 is adapted and configured to support an end of the engine's crankshaft and thereby defines a crankshaft axis about which the crankshaft rotates when the engine is in operation. The crankshaft axis and the camshaft axis are coplanar and thereby define a plane that includes both such axes. It should be appreciated that the camshaft support 20 and the crankshaft support 22 preferably do not directly support the camshaft and the crankshaft, but rather support bearings, which in turn, support the shafts. Thus, the camshaft support 20 and the crankshaft support 22 need not necessarily comprise cylindrical internal surfaces as shown.

The main body 12 also comprises an arcuate rib 24 that protrudes from a wall of the internal cavity 18 toward the flat surface 16 of the main body 12. Additionally, a ledge 26 is formed along a portion of the perimeter wall 28 of the main body 12 adjacent the arcuate rib 24. The ledge 26 and the terminal end surface 30 of the arcuate rib 24 are preferably coplanar. The perimeter wall 28 of the main body 12 adjacent the ledge 26 and the arcuate rib 24 form a fluid channel 32 therebetween within the internal cavity 18 of the main body. Near the right side of cam cover 10, as shown in the drawing figures, the perimeter wall 28 and the arcuate rib 24 intersect each other. At the intersection of the perimeter wall 28 and the arcuate rib 24, the ledge 26 and the arcuate rib are separated by a relatively small notch 34 formed into the perimeter wall.

Still further, the main body 12 of the cam cover 10 preferably comprises first 36 and second 38 cylindrical bores that intersect each other. The first bore 36 opens into the fluid channel 32 between the arcuate rib 24 and the perimeter wall 28 adjacent the ledge 26. The opening 40 into the first bore 36 from the fluid channel 32 is preferably spaced from both the arcuate rib 24 and the perimeter wall 28 adjacent the ledge 26. The second bore 38 extends from the first bore 36 toward and through the flat surface 16 of the main body 12.

The cam cover 10 also comprises a length of cylindrical tubing 42 that is preferably press-fit or shrunk-fit into the second bore 38 of the main body 12. The opening 44 at the free end of the tubing 42 forms a fluid outlet opening that is in fluid communication with the fluid channel 32 discussed above.

The piece of sheet material 14 of the cam cover 10 is adapted and configured to be positioned in the internal cavity 18 of the main body 12 as shown in FIG. 2. The piece of sheet material 14 is preferably a planar piece of material formed out of steel or other suitable materials. Additionally, a plurality of through-holes 46 are preferably formed in the piece of sheet material 14 to allow the piece of sheet material to be secured in engagement with the main body 12 of the cam cover 10 via threaded fasteners (not shown).

When engaged with the main body 12, the piece of sheet material 14 engages the ledge 26 of the perimeter wall 28 and the terminal end surface 30 of the arcuate rib 24, thereby partially bounding the fluid channel 32 between the arcuate rib and the perimeter wall 28 adjacent the ledge. With the piece of sheet material 14 attached to the main body 12 as described, the fluid channel 32 is completely bounded, with the exception of an opening 48 into the remainder of the internal cavity 18, the opening 40 into the first bore 36 of the main body, and a weep hole 50 created by the notch 34 in the perimeter wall 28. It should also be appreciated that the portion of the internal cavity 18 adjacent the opening 48 into the fluid channel 32 remains unbound by the piece of sheet material 14, and thereby forms a fluid inlet opening 52 into the internal cavity from the environment adjacent the flat surface 16 of the main body 12.

With the cam cover 10 attached to a motorcycle engine, the crankcase chamber of the engine is in fluid communication with the fluid inlet opening 52 into the internal cavity 18 of the cam cover. Moreover, the fluid channel 32, the first 36 and second 38 bores, and the tubing 42 create a fluid passageway between the fluid inlet opening 52 into the internal cavity 18 of the cam cover 10 and the fluid outlet opening 44 of the tubing connected to the second bore. Thus, fluid can travel from the crankcase chamber of the motorcycle engine into the internal cavity 18 of the cam cover 10 via the fluid inlet opening 52, and from there, through the opening 48 into the fluid channel, 32, along the fluid channel, into the first bore 36 through the opening 40 thereof, into the second bore 38, and then through the tubing 42 and out of the cam cover through the opening 44 at the terminal end of the tubing. It should be appreciated that, when the cam cover is attached to the engine, the opening 44 at the terminal end of the tubing 42 is in fluid communication with a fluid passageway leading to the head of the engine. Thus, via the cam cover 10, gaseous fluid is able to pass from the crankcase chamber to the head of the engine, and eventually be expelled from the motorcycle, either directly or through the air intake system of the engine.

The fluid passageway of the cam cover 10 of the preferred embodiment of the invention provides several advantages over the fluid passageway of a typical prior art cam cover. One advantage is that by routing the fluid passageway above both the camshaft support 20 and the crankshaft support 22, rather than between them, the cross-sectional area of the majority of the fluid passageway can be made larger. As such, the fluid passageway is less restrictive to fluid flow. Additionally, the increased cross-sectional area of the fluid passageway results in lower fluid velocities through the fluid passageway and thereby facilitates the settling and separation of oil from the gaseous fluid being vented. To this end, it should be appreciated that the fluid channel 32 covered by the piece of sheet material 14 is much larger in cross-sectional area than are the first 36 and second 38 bores of the fluid passageway. As such, fluid travels relatively slowly through the fluid channel 32 prior to being drawn into the opening 40 of the first bore 36 of the fluid passageway. Moreover, the routing of the fluid passageway above both the camshaft support 20 and the crankshaft support 22 increases the length of the fluid passageway and thereby allows greater time for oil to settle out of the gaseous fluid being vented. Thus, the entire fluid channel 32 essentially acts as a settling chamber for allowing suspended oil to precipitate out of mixture with the gaseous fluids being vented. The precipitated oil flows downward and out of the fluid channel 32 via the weep hole 50. It should be appreciated that some gaseous fluid may be drawn into the fluid channel 32 via the weep hole 50 and thus not necessarily all the fluid expelled from the fluid outlet opening 44 is drawn in through the opening 48 into the fluid channel. Nonetheless, the size of the weep hole 50 is relatively small compared to the cross-sectional area of the fluid channel 32 and therefore a vast majority of the fluid expelled is drawn in through the opening 48 into the fluid channel.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. A cam cover of a motorcycle engine comprising:

a main body, the main body comprising an internal cavity, a camshaft support, and a crankshaft support, the camshaft support defining a camshaft axis and the crankshaft support defining a crankshaft axis, the camshaft axis and the crankshaft axis being coplanar such that the camshaft axis and the crankshaft axis define a plane that includes the camshaft axis and the crankshaft axis;

a fluid inlet opening that is adapted and configured to allow fluid communication between the internal cavity of the main body and a first region of a fluid environment external to the cam cover;

a fluid outlet opening that is adapted and configured to allow fluid communication between the internal cavity of the main body and a second region of the fluid environment external to the cam cover, the fluid outlet opening being positioned in a manner such that the plane is between the fluid inlet opening and the fluid outlet opening;

a piece of sheet material positioned within the internal cavity of the main body, the sheet material being engaged with the main body; and a fluid passageway that is configured and adapted to channel fluid from the fluid inlet opening to the fluid outlet opening within the internal cavity of the main body, the fluid passageway being defined partially by a portion of the main body and partially by the piece of sheet material, one of the camshaft axis and the crankshaft axis being positioned between the fluid passageway and the other of the camshaft axis and the crankshaft axis.

2. A cam cover in accordance with claim 1 wherein the piece of sheet material is planar.

3. A cam cover in accordance with claim 1 wherein the piece of sheet material intersects the plane and partially bounds the fluid passageway at such intersection.

4. A cam cover in accordance with claim 3 wherein the camshaft axis is positioned between the crankshaft and the fluid passageway.

5. A cam cover of a motorcycle engine comprising;

a main body, the main body comprising an internal cavity, a camshaft support, and a crankshaft support, the camshaft support defining a camshaft axis and the crankshaft support defining a crankshaft axis, the camshaft axis and the crankshaft axis being coplanar such that the camshaft axis and the crankshaft axis define a plane that includes the camshaft axis and the crankshaft axis;

a fluid inlet opening that is adapted and configured to allow fluid communication between the internal cavity of the main body and a first region of a fluid environment external to the cam cover;

a fluid outlet opening that is adapted and configured to allow fluid communication between the internal cavity of the main body and a second region of the fluid environment external to the cam cover, the fluid outlet opening having a minimum cross-sectional area and being positioned in a manner such that the plane is between the fluid inlet opening and the fluid outlet opening; and a fluid passageway that is configured and adapted to channel fluid from the fluid inlet opening to the fluid outlet opening within the internal cavity of the main body, the fluid passageway having a cross-sectional area in the plane, the cross-sectional area of the fluid passageway being at least twice the minimum cross-sectional area of the fluid outlet opening, one of the camshaft axis and the crankshaft axis being positioned between the fluid passageway and the other of the camshaft axis and the crankshaft axis.

6. A cam cover of a motorcycle engine comprising;

a main body, the main body being a single monolithic part and comprising an internal cavity, a camshaft support, and a crankshaft support, the camshaft support defining a camshaft axis and the crankshaft support defining a crankshaft axis, the camshaft axis and the crankshaft axis being coplanar such that the camshaft axis and the crankshaft axis define a plane that includes the camshaft axis and the crankshaft axis;

a fluid inlet opening that is adapted and configured to allow fluid communication between the internal cavity of the main body and a first region of a fluid environment external to the cam cover;

a fluid outlet opening that is adapted and configured to allow fluid communication between the internal cavity of the main body and a second region of the fluid environment external to the cam cover, the fluid outlet opening being positioned in a manner such that the plane is between the fluid inlet opening and the fluid outlet opening;

a piece of sheet material positioned within the internal cavity of the main body, the sheet material being engaged with the main body; and a fluid passageway that is configured and adapted to channel fluid from the fluid inlet opening to the fluid outlet opening within the internal cavity of the main body, the fluid passageway being defined partially by a portion of the main body and partially by the piece of sheet material.

7. A cam cover in accordance with claim 6 wherein the piece of sheet material is planar.

8. A cam cover in accordance with claim 6 wherein one of the camshaft axis and the crankshaft axis is positioned between the fluid passageway and the other of the camshaft axis and the crankshaft axis.

9. A cam cover in accordance with claim 8 wherein the camshaft axis is positioned between the crankshaft axis and the fluid passageway.

10. A cam cover in accordance with claim 6 wherein the fluid outlet opening has a minimum cross-sectional area and the fluid passageway has a cross-sectional area in the plane, the cross-sectional area of the fluid passageway being at least twice the minimum cross-sectional area of the fluid outlet opening.

11. A cam cover in accordance with claim 6 wherein the piece of sheet material intersects the plane and partially bounds the fluid passageway at such intersection.

12. A cam cover in accordance with claim 11 wherein one of the camshaft axis and the crankshaft axis is positioned between the fluid passageway and the other of the camshaft axis and the crankshaft axis.

13. A method comprising:

providing a motorcycle, the motorcycle comprising a cam cover, the cam cover comprising a main body, a camshaft support, a crankshaft support, a fluid inlet opening, a fluid outlet opening, and a piece of sheet material, the camshaft support defining a camshaft axis and the crankshaft support defining a crankshaft axis, the camshaft axis and the crankshaft axis being coplanar such that the camshaft axis and the crankshaft axis define a plane that includes the camshaft axis and the crankshaft axis, the fluid outlet opening being positioned in a manner such that the plane is between the fluid inlet opening and the fluid outlet opening, the piece of sheet material being engaged with the main body of the cam cover; and operating the motorcycle in a manner such that a mixture of fluid passes from the fluid inlet opening to the fluid outlet opening within the cam cover, the mixture passing from the fluid inlet opening to the fluid outlet opening along a fluid passageway in a manner such that one of the camshaft axis and the crankshaft axis is located between the other of the camshaft axis and the crankshaft axis and a region where at least a majority of the mixture traverses the plane, the fluid passageway being partially bound by the main body of the cam cover and partially bound by the piece of sheet material.

14. A method in accordance with claim 13 wherein the step of operating the motorcycle occurs in a manner such that the region where the majority of the mixture traverses the plane is greater in area than is the fluid outlet opening.

15. A method in accordance with claim 13 wherein the step of providing the motorcycle occurs in a manner such that the piece of sheet material intersects the plane and partially bounds the fluid passageway at such intersection.

* * * * *